US006260496B1

(12) United States Patent
Chevalier

(10) Patent No.: US 6,260,496 B1
(45) Date of Patent: Jul. 17, 2001

(54) PREFABRICATED CABIN FOR A SHIP, AND A METHOD OF INSTALLING SUCH CABINS IN A SHIP

(75) Inventor: Jean-Claude Chevalier, Ste Anne sur Brivet (FR)

(73) Assignee: Alstom France S.A., Paris (FR)

( * ) Notice: Subject to any disclaimer, the term of this patent is extended or adjusted under 35 U.S.C. 154(b) by 0 days.

(21) Appl. No.: 09/417,067

(22) Filed: Oct. 13, 1999

(30) Foreign Application Priority Data

Oct. 13, 1999 (FR) ..... 9813043

(51) Int. Cl.[7] ..... B63B 29/02
(52) U.S. Cl. ..... 114/71; 114/85
(58) Field of Search ..... 52/745.19, 745.2, 52/79.1; 114/65 R, 71, 85, 189

(56) References Cited

U.S. PATENT DOCUMENTS 3,729,889 * 5/1973 Baruzzini ..... 52/264
6,016,636 * 1/2000 Caputo ..... 52/745.2

FOREIGN PATENT DOCUMENTS 94 02 979 6/1994 (DE) .
731020 * 11/1996 (EP) .
2 615 816 A1 12/1988 (FR) .
4-306192 10/1992 (JP) .
WO 97/24258 7/1997 (WO) .

* cited by examiner

*Primary Examiner*—Ed Swinehart
(74) *Attorney, Agent, or Firm*—Sughrue, Mion, Zinn, Macpeak & Seas, PLLC

(57) ABSTRACT

The invention relates to a prefabricated cabin designed to be installed in a ship, the cabin having sides forming walls, a ceiling and a floor that are made by assembling together interfittable panels, the floor being constituted by an association of panels provided with an extra thickness of insulating material.

7 Claims, 3 Drawing Sheets

PREFABRICATED CABIN FOR A SHIP, AND A METHOD OF INSTALLING SUCH CABINS IN A SHIP

The field of the invention is that of fitting out the interiors of ships.

More precisely, the invention relates to a new type of prefabricated cabin that can be used to perform such fitting out, and to constitute a cabin or some other room for the living quarters of such a ship.

BACKGROUND OF THE INVENTION

It is known from the state of the art that the interior of a ship can be fitted out by using prefabricated structures to form the cabins. Such structures are made up of panels that are generally made of metal and that are lined with an insulating material and interfitted to form sides forming the walls and optionally the ceilings of such cabins. Such prefabricated structures are inserted into the ship while it is being fitted out, and they are placed on a deck of the ship, which deck then forms the floors of said cabins. A subsequent step in fitting out each section of ship constitutes in fixing cladding to one or two alleyway-facing faces of the cabin.

SUMMARY OF THE INVENTION

A main object of the present invention is to provide a novel type of cabin for fitting out the interiors of ships, and a novel method of installing such cabins, making it possible to optimize the costs incurred by such fitting out.

In particular, an object of the present invention is to provide such a cabin that makes it possible to reduce considerably the labor costs incurred by providing fire insulation.

Another object of the present invention is to provide such a cabin that can be prefabricated completely in the workshop.

These various objects are achieved by means of the invention which provides a prefabricated cabin designed to be installed in a ship, said cabin having sides forming walls, a ceiling and a floor that are made by assembling together interfittable panels, said floor being constituted by an association of panels each provided with an extra thickness of insulating material extending beyond the panel proper.

The cabin of the present invention has not only walls and a ceiling but also a floor constituted by assembling together interfittable panels. Such a cabin thus constitutes a complete structure for forming a cabin. On installing such cabins in a section of ship, the cabins merely need to be placed on the deck in said section, each floor of each cabin then constituting a floating floor on said deck.

The use of an insulating material presenting extra thickness, which material may be constituted by slabs of mineral wool, offers the advantage of making it possible to transfer the fire insulation normally provided underneath the deck of the ship into the floors of the cabins. Such a technique makes it possible to reduce considerably the labor costs involved in installing such fire insulation, because it is much easier to use panels having extra thickness of insulating material than to install the fire insulation while building the deck of the ship.

As indicated above, the cabin proposed by the invention is complete or almost complete insofar as it has walls, a ceiling, and a floor. In a particularly advantageous variant, this type of cabin is also provided with a pre-instaled bathroom unit. On fitting out the ship, is necessary merely to connect the bathroom units to the water supply and waste water drainage networks.

In another particularly advantageous variant of the invention, the outside face of at least one of the wall-forming sides of the cabin of the present invention is provided with alleyway wall cladding pre-fixed thereto.

The invention thus provides a complete or almost complete prefabricated cabin that is very easy to install in a section of ship, and that, in addition, has pre-mounted cladding on one of its outside faces so as to constitute the wall of an alleyway.

By installing a row of such cabins in succession, it is thus possible to obtain complete alleyway cladding. It is thus possible to reduce considerably the time required for fitting out a ship because, by prefabricating, in the workshop, cabins provided with cladding on their alleyway-facing outside faces, it is possible to obtain structures enabling both installation of the rows of cabins, and also cladding of the alleyways running along them to be obtained simultaneously.

In another advantageous variant of the invention, the outside face of at least one of the wall-forming sides is provided with cladding serving to constitute the wall-forming side of an adjacent cabin.

In a variant, the outside face of one of the wall-forming sides of a cabin is provided with alleyway wall cladding, and the outside face of another of its wall-forming sides, perpendicular to the first side, is provided with cladding serving to constitute the wall-forming side of an adjacent cabin.

The advantage of the two types of cabin mentioned in the two preceding paragraphs appears more clearly below.

The invention also provides a method of installing a series N of cabins in a section of a ship so as to form at least one row of such cabins, and at least one alleyway, said method comprising the following steps:

forming a breach in said section;

inserting N-3 cabins as described above in turn via the breach, and installing said cabins side-by-side in turn;

then inserting 2 cabins via the breach, the cabins being as described above and having cladding serving to constitute two wall-forming sides of an adjacent cabin, in which the walls formed by the cladding face each other, and installing said 2 cabins so as to leave a space between said walls;

closing off said breach; and installing, in situ and in said space, the floor, the ceiling and the two remaining wall-forming sides so as to constitute the last cabin in said series of N cabins.

BRIEF DESCRIPTION OF THE DRAWINGS

The invention and its various advantages are understood more easily by means of the following description of a non-limiting embodiment of a cabin of the invention, and of a non-limiting implementation of a method of installing cabins of the present invention, given with reference to the drawings, in which.

DETAILED DESCRIPTION OF THE PREFERRED EMBODIMENT

Figure 1:
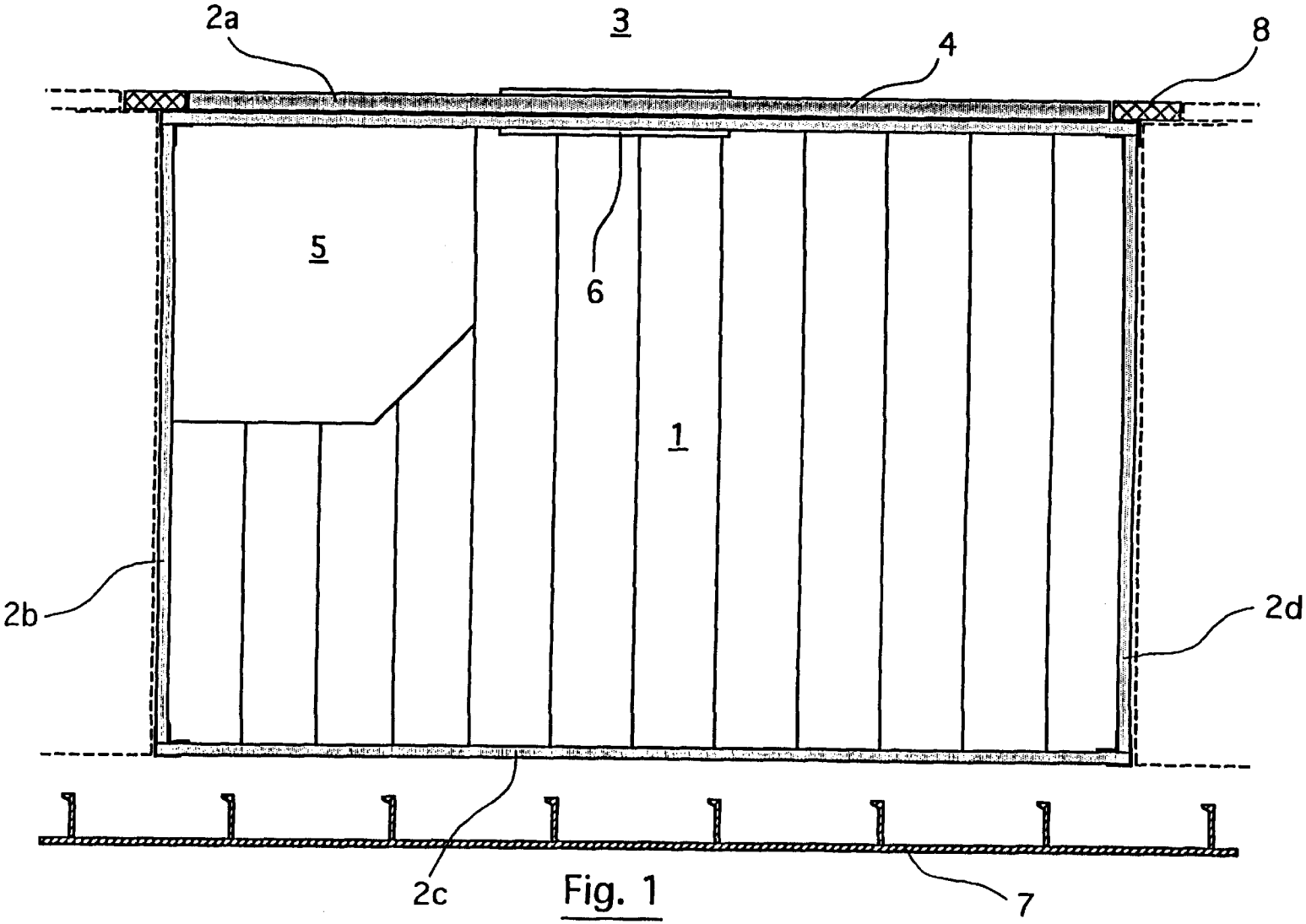
FIG. 1 is a plan view in section of a cabin of the present invention.

With reference to FIG. 1, a prefabricated cabin for a ship is shown in a plan view. To clarify the description, the cabin is shown without its ceiling.

In the present invention, the cabin as prefabricated in the workshop can be installed in a ship whose interior is being fitted out, such installation being of lower cost than prior art installation. The cabin has one floor-forming side 1, four wall-forming sides 2*a,* 2*b,* 2*c,* 2*d,* and one ceiling-forming side. In addition, it is equipped with a bathroom unit 5.

In FIG. 1, the cabin is shown as installed in a ship and flanked by two other cabins shown in dashed lines. The cabins are disposed in a row along an alleyway 3.

Each of the sides making up the cabin is made in the workshop by interfitting modular panels having metal base structures, and by including therein a thermally-insulating and sound-proofing insulating material, namely mineral wool. One of the faces of each of the sides, which face is designed to constitute an inside face of the cabin, is lined with a decorative material (paint, wall-covering, etc.). The sides are then assembled together, also in the workshop, so as to constitute the cabin, while the bathroom unit 5 is also installed in this step. The outside face of one of the sides 2*b* of the cabin is then equipped with cladding 4 serving to constitute a portion of the wall of the alleyway 3. As shown in FIG. 1, the assembly made up of the side 2*a* and of the cladding 4 is provided with a door unit 6 opening onto the alleyway 3.

Figure 3:
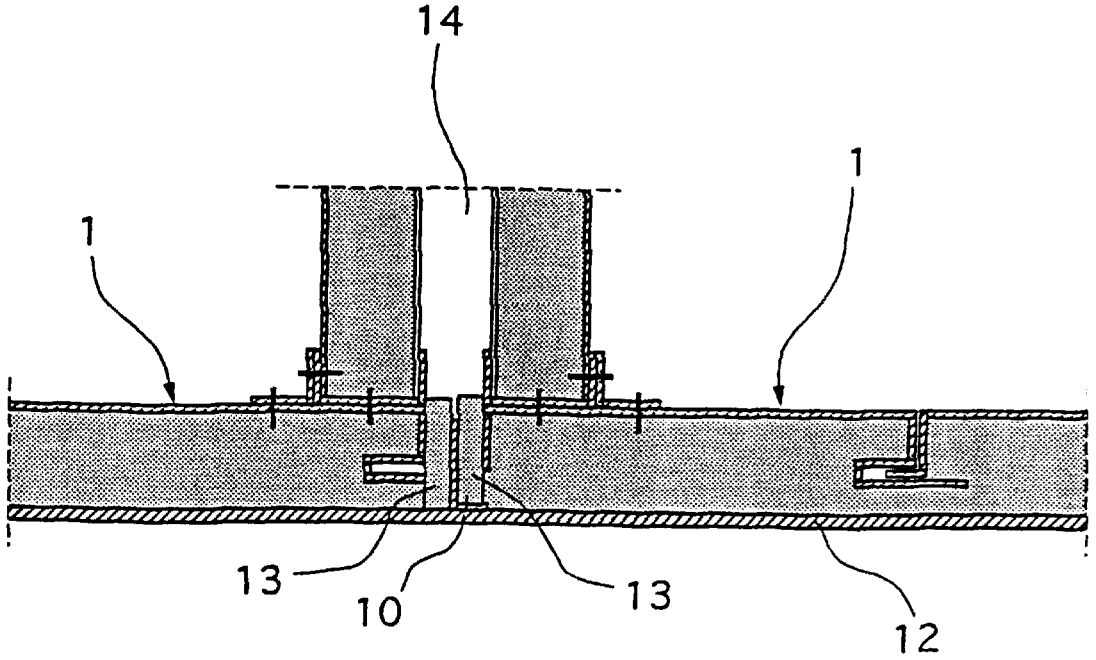
FIG. 3 is a fragmentary cross-section view of two cabins at their floating floors.

The resulting box can thus constitute a complete cabin including a floor that is easy and quick to install on a ship deck against the metal sheeting 7 thereof. Once the cabin has been fixed against the metal sheeting, junction elements 8 are used to interconnect the various segments of cladding of the successive cabins, which segments form the wall of the alleyway. Shim-forming elements 13 are also used between the cabins (as shown in FIG. 3).

Figure 2:
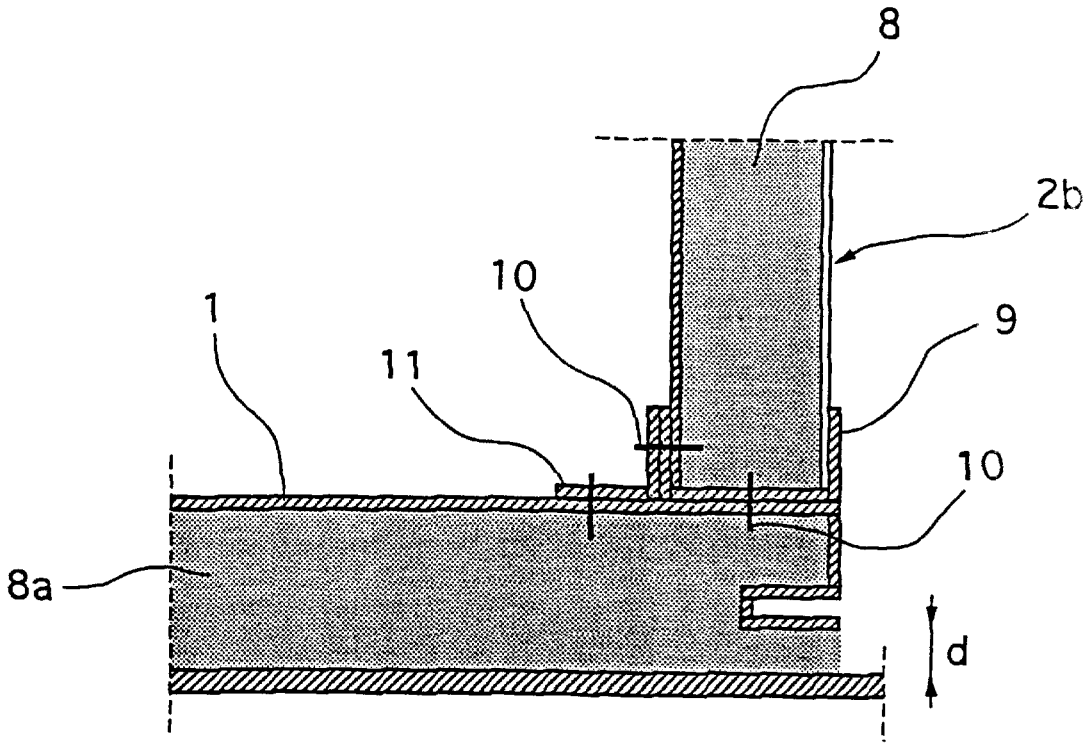
FIG. 2 is a cross-section view of a portion of the floor of a cabin of the present invention.

With reference to FIG. 2, the floor-forming side 1 and the side forming one of the walls 2*b* of the cabin as shown in FIG. 1, are shown in fragmentary section. The panels forming the sides have metal structures filled with slabs of mineral wool 8, 8*a*.

In the present invention, the insulating material 8*a* of the panels making up the floor 1 has extra thickness "d" extending beyond the panel proper. The extra thickness "d" makes it possible to provide the fire insulation of the cabin, and thus to satisfy the safety criteria imposed in the field of shipbuilding. It should be noted that, in the state of the art, in which prefabricated cabins do not have floors, and are placed directly on the deck of the ship, the fire insulation is obtained by providing an insulating material under said deck, which, by means of the invention, is not necessary. The invention thus makes it possible to transfer the fire insulation into the floor which can be prefabricated in the workshop. As a result, the cost of implementing such insulation is reduced very considerably.

The junction between the floor-forming side 1 and the wall-forming side 2*b* is implemented by providing a bottom channel-section member 9 and an angle iron 11 cooperating with said sides by using fixing means 10, at the base of the wall-forming side.

With reference to FIG. 3, the floor-forming side 1 and one of the wall-forming sides of each of two adjacent cabins are shown in cross-section. The sides 1 form a floating floor on the deck 12 of the ship. Shims 13 are used between the adjacent cabins so as to maintain a cavity 14 between them, which cavity constitutes thermal insulation. The shims may optionally be fixed to the deck 12 by suitable fixing means 10.

FIG. 3 also shows the precise structure of the interfittable panels encompassed by the present invention. These panels offer the advantage of minimizing the number of fixing means for fixing the panels together. It should be noted that all of the interfittable panels used for forming the floor, the ceiling, and the walls of the cabin are of substantially the same structure, except that the panels used for the floor have an extra thickness of insulating material extending from the panels proper.

Figure 4:
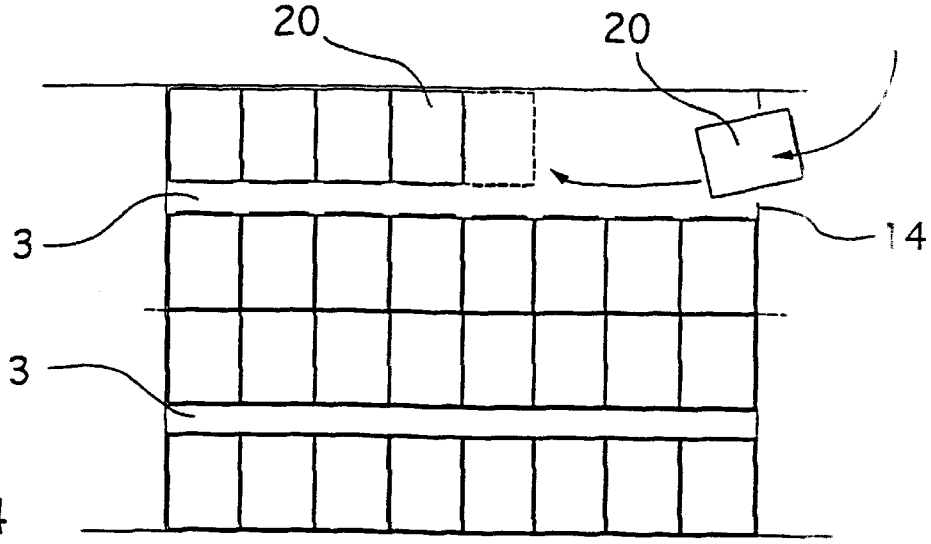
FIGS. 4, 5, and 6 show the various steps of a method of installing cabins of the present invention.
Figure 5:
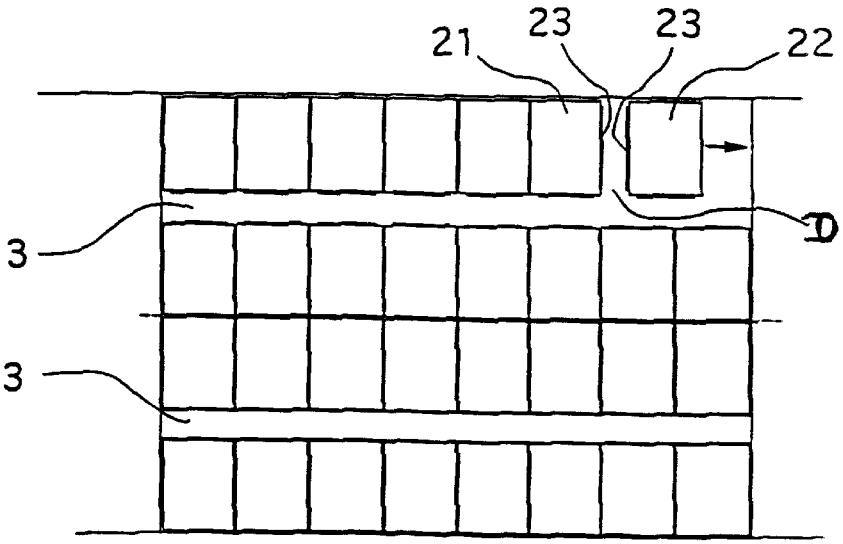
Figure 6:
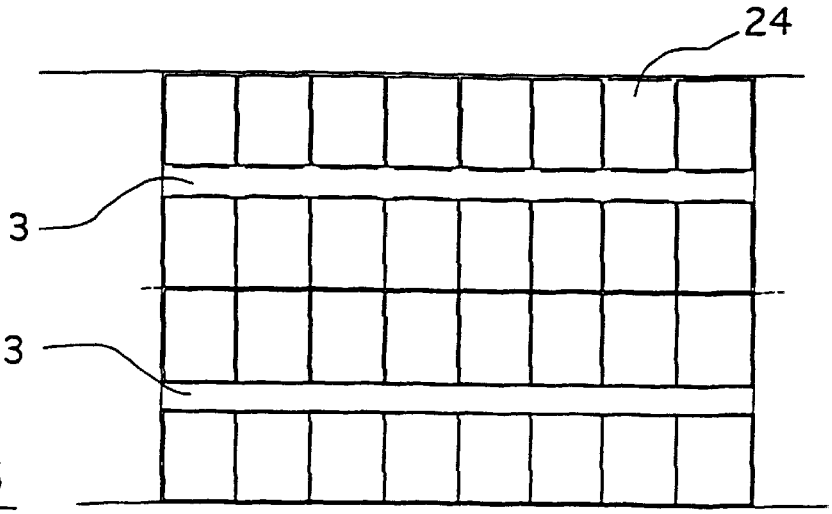

FIGS. 4, 5, and 6 are diagrammatic plan views showing how a batch of N cabins are installed in a section of a ship, the cabins being distributed in four rows on either side of two alleyways 3. In the context of this example, N is equal to 32 and corresponds to four rows of eight cabins.

In a first step of the method of installing of the present invention, N-3, i.e. 29, cabins (given reference 20 in the figures) as described with reference to FIG. 1, i.e. each showing a segment of cladding constituting a portion of cladding for the alleyway on one of its outside faces, are installed in turn in the section of the ship. The cabins are inserted into the section of the ship via a cutout 14. This step is shown in FIG. 4 which shows the 29th cabin being inserted into the section, with the final position of said cabin being shown in dashed lines.

In a second step, two cabins (referenced 21 and 22 in the figures) are inserted into the section 2, each of the two cabins being similar to the preceding cabins but, in addition, showing a wall-forming side whose outside face is equipped with cladding 23 serving to constitute the wall-forming side of an adjacent cabin. Each of the cabins 21 and 22 thus has two mutually perpendicular wall-forming sides equipped with cladding, one forming a portion of alleyway cladding, and the other forming the side of an adjacent cabin. These cabins are installed in the section by leaving a space D between them that is substantially of the same size as a cabin, with their sides equipped with cladding 22 facing each other. In FIG. 5, the cabin 22 is shown while it is being installed, prior to it being fixed against the sheet metal at the cutout 14 which has been closed off, as indicated by the arrow.

The last step consists in forming the last cabin 24 of the batch N in situ, by merely installing the sides forming the back wall, the floor, and the ceiling, and the alleyway-facing side of the cabin. The sides forming the side walls are already present because they are provided by the adjacent cabins.

The above-described method makes it possible to reduce the costs of installing cabins. It enables alleyways to be clad simultaneously with such installation, while also enabling the fitting out of a section to be finalized, while involving in-situ assembly of one cabin only.

The above-described implementation of the invention in no way limits the scope of the invention. Numerous modifications may be made to it without going beyond the ambit of the invention. In particular, it should be noted that the panels used to make up the sides may be of other shapes.

What is claimed is:

1. A prefabricated cabin design to be installed in a ship, said cabin comprising:

a plurality of interfittable panels, said panels being assembled together to form sides which form walls, a ceiling and a floor of said cabin, wherein said panels comprising said walls and ceiling have a first thickness of insulating material, and said panels comprising said floor have a second thickness of insulating material, said second thickness being greater than said first thickness.

2. A cabin according to claim 1, further comprising a bathroom unit.

3. A cabin according to claim 2, wherein an outside face of at least one of the wall-forming sides is provided with alleyway wall cladding.

4. A cabin according to claim 1, wherein an outside face of at least one of the wall-forming sides is provided with cladding serving as a wall-forming side of an adjacent cabin.

5. A cabin according to claim 1, wherein an outside face of one of the wall-forming sides is provided with alleyway wall cladding, and wherein an outside face of another of its wall-forming sides, perpendicular to the side the one wall-forming side provided with alleyway wall cladding, is provided with cladding serving as a wall-forming side of an adjacent cabin.

6. A method of installing a series N of cabins in a section of a ship so as to form at least one row of such cabins, and at least one alleyway, said method comprising the steps of:

forming a breach in said section;

inserting N-3 cabins, each of said cabins comprising a plurality of interfittable panels, said panels being assembled together to form sides which form walls, a ceiling and a floor of said cabin, wherein said panels comprising said walls and ceiling have a first thickness of insulating material, and said panels comprising said floor have a second thickness of insulating material, said second thickness being greater than said first thickness, in turn via the breach, installing said cabins side-by-side in turn;

then inserting two cabins adjacent one another, wherein an outside face of at least one of the wall-forming sides is provided with cladding serving as a wall-forming side of the adjacent cabin, via the breach, with the walls formed by the cladding serving as two wall-forming sides of the adjacent cabin facing each other;

installing said two cabins so as to leave a space between said walls;

closing off said breach; and installing, in situ and in said space, the floor, the ceiling and the two remaining wall-forming sides as a last cabin in said series of N cabins.

7. A method according to claim 6, wherein said N-3 cabins are cabins wherein an outside face of at least one of the wall-forming sides is provided with alleyway wall cladding, and said two cabins are cabins wherein an outside face of another of its wall-forming sides, perpendicular to the side of the one wall-forming side provided with alleyway wall cladding, is provided with cladding serving as a wall-forming side of the adjacent cabin.

* * * * *

UNITED STATES PATENT AND TRADEMARK OFFICE

CERTIFICATE OF CORRECTION

PATENT NO. : 6,260,496 B1 
DATED : July 17, 2001
INVENTOR(S) : Jean-Claude Chevalier It is certified that error appears in the above-identified patent and that said Letters Patent is hereby corrected as shown below:

Title page,
Item [30], Foreign Application Priority Data, please correct the priority date as follows:
-- Oct. 14, 1998 (FR) 9813043 --.

Signed and Sealed this

Twenty-fifth Day of October, 2005

JON W. DUDAS
*Director of the United States Patent and Trademark Office*